US007375685B1

(12) United States Patent
Nalbandian

(10) Patent No.: US 7,375,685 B1
(45) Date of Patent: May 20, 2008

(54) DUAL BAND ELECTRICALLY SMALL MICROSTRIP ANTENNA

(75) Inventor: Vahakn Nalbandian, Schwenksville, PA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 268 days.

(21) Appl. No.: 11/416,511

(22) Filed: Apr. 18, 2006

(51) Int. Cl.
*H01Q 1/38* (2006.01)

(52) U.S. Cl. ..... 343/700 MS; 343/803; 343/846; 343/829

(58) Field of Classification Search ..... 343/700 MS
See application file for complete search history.

(56) References Cited

U.S. PATENT DOCUMENTS

| | | | | |
|---|---|---|---|---|
| 5,561,435 | A * | 10/1996 | Nalbandian et al. | 343/700 MS |
| 6,362,785 | B1 * | 3/2002 | Nalbandian et al. | 343/700 MS |
| 6,870,506 | B2 * | 3/2005 | Chen et al. | 343/700 MS |
| 6,958,730 | B2 * | 10/2005 | Nagumo et al. | 343/702 |
| 7,042,403 | B2 * | 5/2006 | Colburn et al. | 343/702 |
| 7,265,718 | B2 * | 9/2007 | Tsai | 343/700 MS |
| 2004/0012528 | A1 * | 1/2004 | Dai et al. | 343/702 |
| 2004/0196187 | A1 * | 10/2004 | Yeh | 343/700 MS |
| 2006/0279464 | A1 * | 12/2006 | Mei | 343/700 MS |

* cited by examiner

*Primary Examiner*—Trinh V Dinh
(74) *Attorney, Agent, or Firm*—Michael Zelenka; George B. Tereschuck

(57) ABSTRACT

A multiple band electrically small compact planar microstrip antenna at VHF and UHF frequencies is provided that permits both a considerably abbreviated antenna length and significantly high efficiency antenna performance. The multiple band electrically small compact planar microstrip antenna advantageously positions a narrow radiating strip and a group of unequally dimensioned radiating members on a microstrip dielectric substrate that is stacked on a ground plane. The unequally dimensioned, or unlike, radiating members are separated by at least one gap and cause the antenna to resonate at a number of different frequencies instead of a single frequency as the prior art microstrip antenna. The multiple band electrically small compact planar microstrip antenna also innovatively filters unwanted signals at other frequencies because of the narrowband nature of each band. The preferred embodiment is a dual band electrically small compact planar microstrip antenna with two unlike radiating members separated by a single gap. This invention also encompasses methods for providing substantial reduction in antenna size at the VHF and UHF frequencies with multiple band electrically small planar microstrip antennas.

20 Claims, 4 Drawing Sheets

DUAL BAND ELECTRICALLY SMALL MICROSTRIP ANTENNA

GOVERNMENT INTEREST

The invention described herein may be manufactured, used, imported, sold, and licensed by or for the Government of The United States of America without the payment to me of any royalty thereon.

FIELD OF THE INVENTION

The present invention relates generally to the field of microstrip antennas, and more particularly to multiple band compact planar microstrip antennas.

BACKGROUND OF THE INVENTION

Microstrip antennas with a lightweight, low profile, low cost and planar structure have been replacing bulky antennas. The length of a rectangular microstrip antenna is about a half wavelength within the dielectric medium under a radiating patch. A half wavelength is still relatively large at UHF and VHF frequencies and these frequencies also impose size limitations that can result in bulky and cumbersome antenna structures. However, microstrip antennas, particularly the electrically small microstrip antennas, have a rather narrow bandwidth. This narrow bandwidth has been tolerated because most modern communications systems generally only need a few distinct frequencies, e.g. one to transmit and one to receive, rather than a continuous spectrum of operating frequency. The disadvantages, drawbacks, limitations and shortcomings of conventionally-sized narrow-band microstrip antennas have created a long-felt need for more compact multiple band antenna structures at lower frequencies that are also low-cost, rugged and conformal in nature. Up until now, it has not been possible to employ planar microstrip antennas without the disadvantages, limitations and shortcomings associated with antenna length and size.

Aside from the need for compact multiple band antenna structures, the prior art narrowband microstrip antennas have suffered from a number of other problems. One continuing problem with prior art narrowband microstrip antennas is unwanted antenna length of a half wavelength length within the dielectric medium, and they also suffer from other size-related drawbacks and disadvantages such as excessive cost and cumbersomeness. Thus there has been a long-felt and unsatisfied need for a multiple band electrically small microstrip antenna for the VHF and UHF frequencies.

The present invention makes it possible to fulfill the need for a significantly reduced antenna length and an electrically small multi-band antenna without suffering from the disadvantages, shortcomings and limitations of lengthy, costly and cumbersome conventional microstrip antennas.

SUMMARY OF THE INVENTION

The present invention fulfills the long-standing need for a significantly reduced antenna length and an electrically small antenna for the VHF and UHF frequencies with a multiple band electrically small compact planar microstrip antenna comprising a group of unequally dimensioned radiating members positioned on a dielectric substrate which is stacked on a ground plane that permits both a considerably abbreviated antenna length and significantly high efficiency antenna performance. At least two radiating members are separated by a gap.

It is an object of this invention to provide a significantly reduced antenna length and an electrically small microstrip antenna.

It is a further object of this invention to provide a multiple band electrically small compact planar microstrip antenna with a significantly reduced antenna size.

These and other objects are advantageously accomplished with the present invention providing a multiple band electrically small compact planar microstrip antenna comprising stacking a plurality of radiating members, a microstrip dielectric substrate and a ground plane to provide a multiple band electrically small, compact, planar microstrip antenna at VHF and UHF frequencies. The unequally dimensioned radiating members of the present invention advantageously provide an antenna that resonates at a number of different frequencies instead of a single frequency as the prior art microstrip antenna. The multiple band electrically small compact planar microstrip antenna also innovatively filters unwanted signals at other frequencies because of the narrowband nature of each band. This invention also encompasses methods for providing substantial reduction in antenna size at the VHF and UHF frequencies with multiple band electrically small planar microstrip antennas.

DETAILED DESCRIPTION OF THE DRAWINGS

The multiple band electrically small compact planar microstrip antenna of the present invention advantageously comprises a number of radiating members positioned on a microstrip dielectric substrate stacked on a ground plane in an innovative stacking arrangement that provides an electrically small, abbreviated length for a microstrip antenna with the advantages of multiple band capability in the VHF and UHF frequencies. This invention's multiple band electrically small planar compact microstrip antenna is electrically small in the sense that its wavelength is less than a tenth of a wavelength within the dielectric medium. One tenth of a wavelength compares favorably with prior art rectangular microstrip antennas with a half wavelength length within the dielectric medium. This is most particularly the case when the prior art one half wavelength in the VHF and UHF regions caused a relatively large antenna length that led to other size-related drawbacks and disadvantages. Further, the unequally dimensioned, or unlike, radiating members are composed of a number of rectangular conductive strips with varying widths that cooperate to reduce the effective impedance of the antenna structure. This advantageous arrangement along with the innovative combination of a multiple band with an electrically small microstrip antenna results in a substantially reduced antenna length that is significantly shorter than conventional prior art microstrip antennas, without suffering from any of the disadvantages, drawbacks and limitations associated with more lengthy prior art conventional microstrip antennas.

Before any further detailed description of the present invention, it may be instructive to briefly review the underlying concepts and theory of compact microstrip antenna operation. In a single frequency microstrip antenna, a junction in the middle of the patch may be introduced to shorten the length of the impedance transition from the center point, where the wave impedance disappears, to the edge of the radiating patch, where the impedance becomes very large. The simplest example of this phenomenon is the illustrative microstrip antenna depicted in FIGS. 1 and 2 where two rectangular patches of different widths are connected to each other and the narrow patch is electrically shorted.

Figure 1:
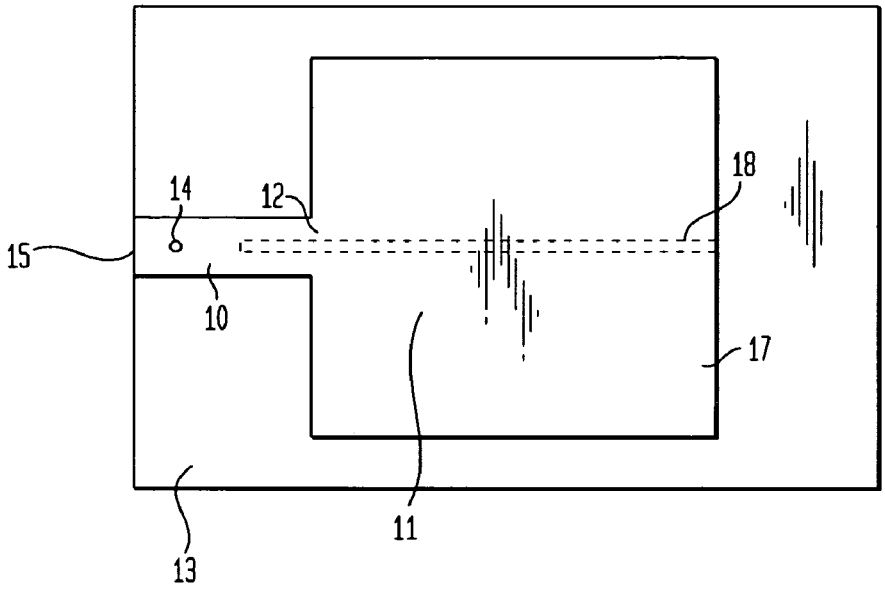
FIG. 1 is a top view of an illustrative microstrip antenna with rectangular patches connected to each other.
Figure 2:
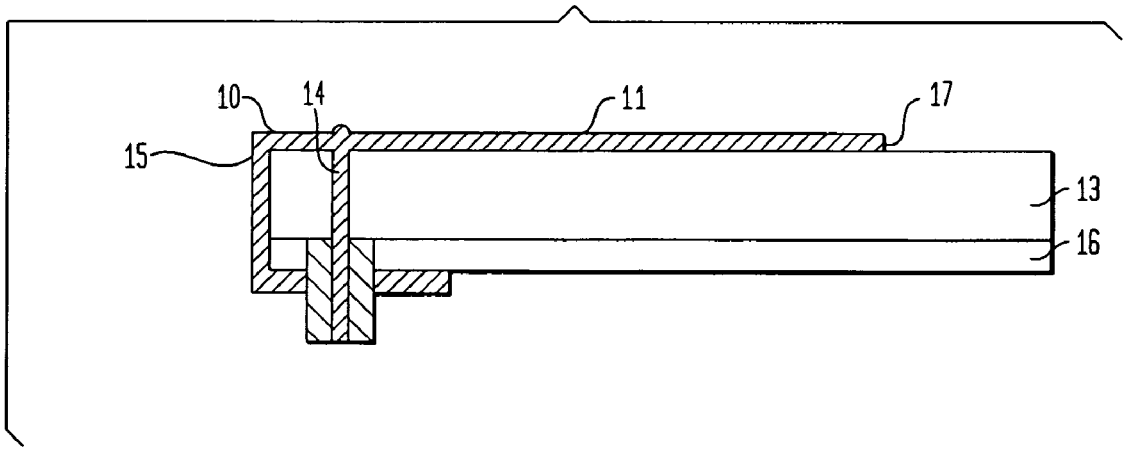
FIG. 2 is a cutaway side view of the FIG. 1 illustrative microstrip antenna with rectangular patches stacked on a dielectric substrate and ground plane.

Referring now to FIG. 1, there is depicted a narrow radiating strip 10 connected to a wide radiating patch 11 at a junction 12, both mounted on a dielectric substrate 13. In this illustration, the effective impedance, which is to be satisfied by the narrow strip 10 at junction 12, is greatly reduced by the presence of the two differently dimensioned patches 10 and 11 of different widths there. This decreases the size of the antenna greatly for the required frequency range. Connector pin 14 is positioned on the narrow strip 10 and extends downward through the dielectric substrate 13 to the ground plane 16, which is shown in FIG. 2. The narrow rectangular strip 10, being folded over the dielectric substrate 13 and ground plane 16 defines a front edge 15. The wide radiating patch 11 terminates in a rear edge 17. Testing the FIG. 1 illustrative single frequency microstrip antenna resulted in a resonant frequency of 374 MHz, while a conventional microstrip antenna fabricated with Duroid 5880 material, a 2.2 dielectric constant and the same antenna length provided a resonance of 1.81 GHz, which permits a five-fold antenna length shrinkage, or reduction. The present inventor has observed that this shrinkage will increase as the ratio of the width of the rectangular wide patch 11 and narrow strip 10 increases. FIG. 2 depicts a cutaway side view of the FIG. 1 illustrative microstrip antenna with rectangular patches 10 and 11 stacked on the dielectric substrate 13 and ground plane 16. The narrow rectangular strip 10 partially covers the dielectric substrate 13 and ground plane 16, opposes the rear edge 17 and terminates at the connector pin 14.

In an effort to make the illustrative single frequency microstrip antenna resonate at two different frequencies, and now referring back to FIG. 1, a gap 18, or crack, shown by broken lines in this drawing, was established that begins between connector pin 14 and junction 12 in the narrow radiating strip 10 and extends lengthwise through junction 12 to the edge 17 of the wide radiating patch 11. The gap 18 creates two different resonating sections, or radiating members, which are essential elements of this invention, and are shown in more detail in FIGS. 3-5. When the dimensions of the radiating members on both sides of the gap 18 are identical, then such a symmetrical antenna will resonate at only one frequency. This inventor has found that if one or more of these equalities do not hold, as is the case with the microstrip antennas of the present invention, then the two unequally-dimensioned, or unlike radiating members will resonate at different frequencies, making the entire structure a multiple band antenna.

In a second experiment, a 45.5 mm long 1.4 mm wide gap was made lengthwise down the middle of a narrow strip and wider radiating member, and this resulted in a single resonant frequency of 375 MHz, or 1 MHz higher than the first experiment because of a slight reduction in the area of the narrow strip and wide radiating member, due to the gap. The lengths of the narrow strip and radiating member were changed to provide a longer radiating member of 31.5 mm on one side of the gap and a shorter radiating member of 19.5 mm on the other side. The resultant multiple band electrically small compact planar microstrip antenna resonated at 410 MHz and 669 MHz, i.e. the longer radiating member (31.5 mm in length) caused the 410 MHz resonance and the significantly shorter radiating member (19.5 mm in length) caused the 669 MHz resonance. The combined narrow strip and wide radiating member, when positioned on dielectric substrate 13 and mounted on ground plane 16 operate as a single antenna, and not as a transmission line split into two narrow transmission lines feeding into two patches like a conventional microstrip antenna array does. Therefore, a conventional microstrip antenna with conventional patch lengths of 31.5 mm and 19.5 mm on standard microstrip material would ordinarily provide resonant frequencies of 3.1 GHz and 5.13 GHz. This is approximately 7.7 times higher than the resonant frequencies achievable with the two radiating members measuring of 31.5 mm and 19.5 mm, as described above, so that this invention's microstrip antenna with those dimensions could have an antenna length about seven times shorter than a conventional array antenna.

Some of the long-felt needs for shorter antenna lengths have been fulfilled by U.S. Pat. No. 5,561,435 entitled "Planar Lower Cost Multilayer Dual-Band Microstrip Antenna," wherein this inventor was a co-inventor, and U.S. Pat. No. 6,362,785 "Compact Cylindrical Microstrip Antenna," which are hereby incorporated by reference, but those antennas were still very large at the frequencies of interest. To provide an electrically small antenna capable of reaching the VHF and UHF frequencies in accordance with this invention, it is necessary to shrink the antenna even further to make the antenna compact and usable for moving platforms. The present invention focuses the antenna length reduction effort on splitting the radiating element into multiple radiating members with unequal dimensions separated by at least one gap to reduce the wavelength within the microstrip media without making the antenna inefficient. When two radiating members are used, the gap is a longitudinal gap, and when more radiating members are employed multiple gaps are necessary, including a longitudinal gap, an "L" shaped gap and combinations of those or similar gaps.

Variations include using two, three or four unlike radiating members; rectangularly shaped unlike radiating members; a longitudinal gap that terminates at the rear edges for the two member embodiment; two "L" shaped gaps separating the three unlike radiating members in the three member embodiment; a longitudinal gap and two "L" shaped gaps separating the four radiating members in the four-member embodiment with the longitudinal gap terminating at the rear edges and having the unlike radiating members non-rectangularly shaped in a shape such as a triangle.

Figure 3:
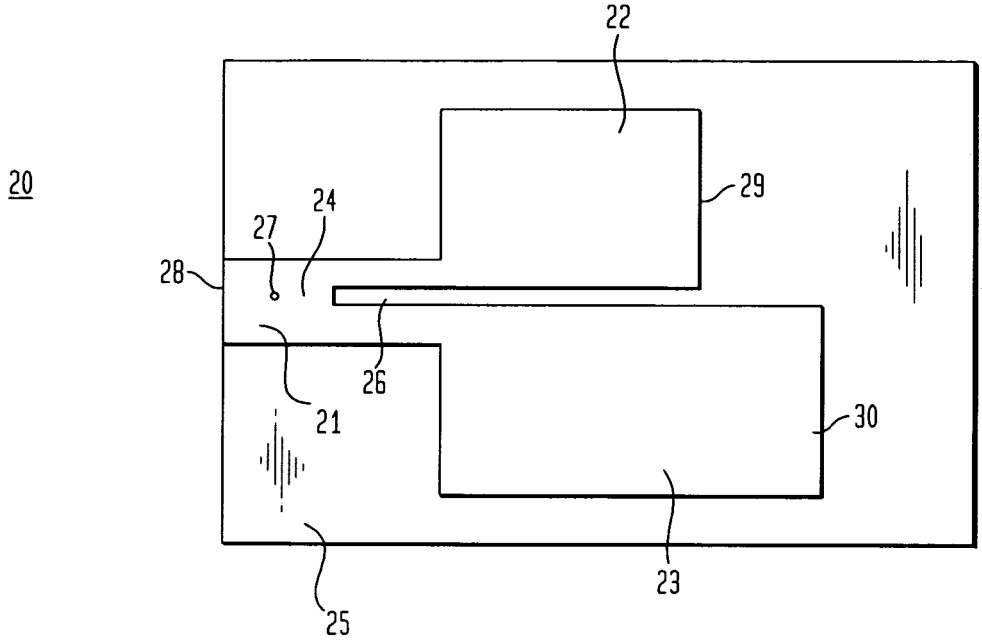
FIG. 3 is a top view of the dual band embodiment of the multiple band electrically small compact planar microstrip antenna of the present invention with the narrow end behind the connector shorted to ground.

Referring now to FIG. 3, there is depicted a top view of the dual band embodiment of the multiple band electrically small compact planar microstrip antenna of the present invention. The dual band electrically small compact planar microstrip antenna 20 of the present invention, comprises a narrow radiating strip 21 connected to a first radiating member 22 and a second radiating member 23 at junction 24. Based upon the relative sizes of the first and second radiating members 22 and 23 they each have unequal, or unlike, dimensions and surface areas and are each wider than the narrow radiating strip 21. The narrow radiating strip 21, first unlike radiating member 22 and the second unlike radiating member 23 are all positioned on a dielectric substrate 25, which, in turn, is stacked on a ground plane, not shown in this drawing, which is functionally equivalent to the FIG. 2 ground plane. A connector pin 27 positioned on the narrow radiating strip 21 projects downward through the dielectric substrate 25 and ground plane causes the narrow radiating strip 21 to electrically short. The first and second unlike radiating members 22 and 23 are separated by at least one gap 26 that begins in the vicinity of the connector pin 27 and extends lengthwise through the junction 24. The narrow radiating strip 21, dielectric substrate 25 and ground plane all share a common front edge 28. The first and second unlike radiating members 22 and 23 terminate at edges 29 and 30, respectively. The narrow radiating strip 21 forms the front edge 28 that partially covers the dielectric substrate 25 and ground plane, opposes the edges 29 and 30 and terminates at the connector pin 27.

A number of the previously disclosed variations also apply to this embodiment, including providing non-rectangular unlike radiating members in shapes such as a triangle. A dielectric constant in the dielectric substrate is necessary. The radiating members may be constructed of any good conductive metal, and in the preferred embodiment they are composed of copper. The ground plane may also be made from conductive materials such as copper and aluminum. The unlike radiating members are depicted as being rectangular, but can be configured in numerous shapes so long as the surface areas have unequal dimensions.

Figure 4:
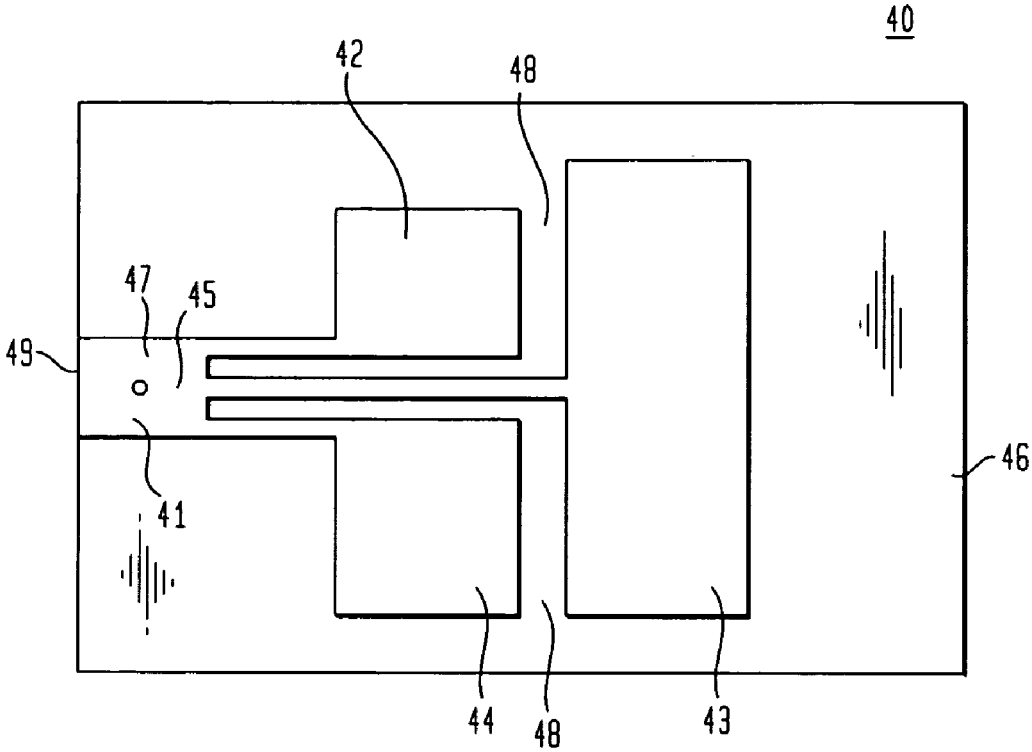
FIG. 4 is a top view of the triple band embodiment of the multiple band electrically small compact planar microstrip antenna of the present invention.

Referring now to FIG. 4, there is depicted a top view of the triple band embodiment of the multiple band electrically small compact planar microstrip antenna of the present invention. The triple band electrically small compact planar microstrip antenna 40 of the present invention, comprises a narrow radiating strip 41 connected to a first radiating member 42, a second radiating member 43 and a third radiating member 44 at junction 45. Based upon the relative sizes of the first, second and third radiating members 32, 33 and 34, respectively, they each have unequal, or unlike, dimensions and surface areas and they are each wider than the narrow radiating strip 41. The narrow radiating strip 41, first radiating member 42, second radiating member 43 and third radiating member 44 are all positioned on a dielectric substrate 46, which, in turn, is stacked on a ground plane, not shown in this drawing that is functionally equivalent to the FIG. 2 ground plane. A connector pin 47 that is positioned on the narrow radiating strip 41 projects downward through the dielectric substrate 46 and ground plane and causes the narrow radiating strip 41 to short. The first, second and third unlike radiating members 42, 43 and 44, respectively, are separated by gaps 48 that begin in the vicinity of connector pin 47, extend through the junction 45 and terminate orthogonally at the second radiating member 43. The narrow radiating strip 41 forms the front edge 49 that partially covers the dielectric substrate 46 and ground plane, opposes the second radiating member 43 and terminates at the connector pin 47.

Many of the variations to the dual band embodiment of this invention apply equally to this embodiment. Other variations include the use of non-rectangular radiating members.

Figure 5:
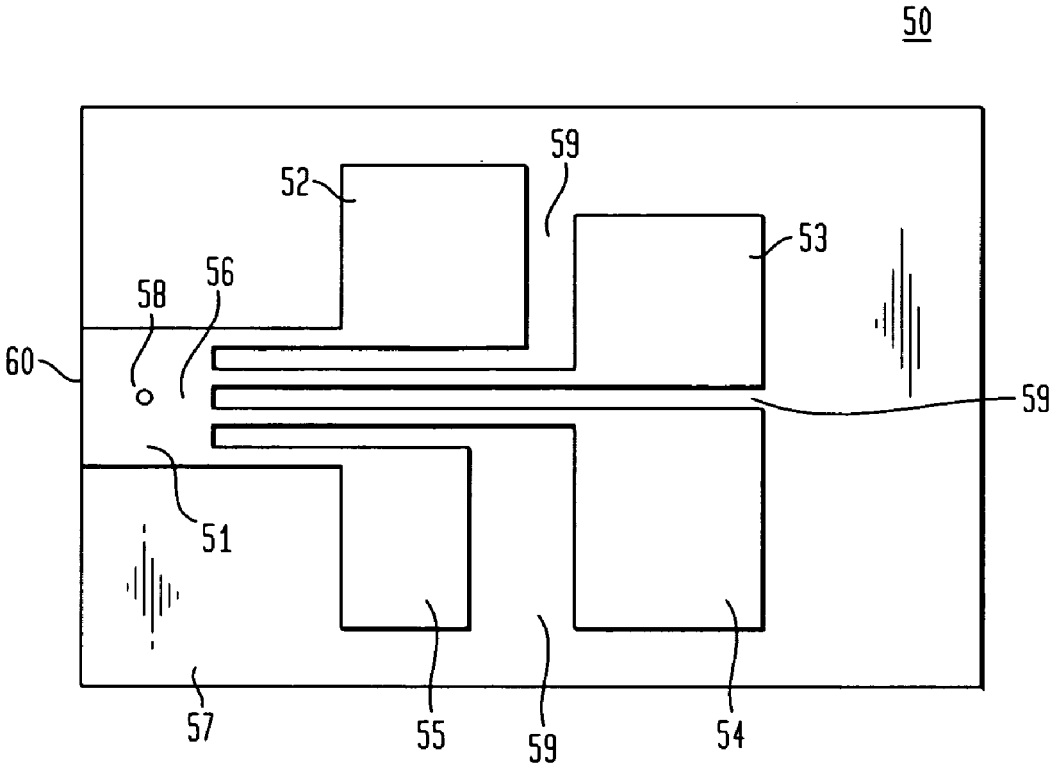
FIG. 5 is a top view of the quad band embodiment of the multiple band electrically small compact planar microstrip antenna of the present invention.

Referring now to FIG. 5, there is depicted a top view of the quad band embodiment of the multiple band electrically small compact planar microstrip antenna of the present invention. The quad band electrically small compact planar microstrip antenna 50 of the present invention, comprises a narrow radiating strip 51 connected to a first radiating member 52, a second radiating member 53, a third radiating member 54 and a fourth radiating member 55 at the junction 56. Based upon the relative sizes of the first, second, third and fourth radiating members 52-55, respectively, they all have unequal, or unlike, dimensions and surface areas and they are each wider than the narrow radiating strip 51. The narrow radiating strip 51, first, second, third and fourth unlike radiating members 52-55, respectively, are all positioned on a dielectric substrate 57, which in turn, is stacked on a ground plane, not shown in this drawing, which is functionally equivalent to the FIG. 2 ground plane. A connector pin 58 that is located on the narrow radiating strip 51 projects downward through the dielectric substrate 57 and ground plane and causes the narrow radiating strip 51 to short. The first, second, third and fourth unlike radiating members 52-55, respectively, are separated by gaps 59 that begin in the vicinity of the connector pin 58, extend through the junction 56 and either terminate orthogonally at the third and fourth radiating members 53 and 54 or extend in between the third and fourth radiating members 53 and 54. The narrow radiating strip 51 forms front edge 60 that partially covers the dielectric substrate 57 and ground plane, opposes the second and third radiating members 53 and 54 and terminates at the connector pin 58.

Many of the variations to the dual band and triple band embodiments of this invention also apply to this embodiment, including the use of non-rectangular radiating members.

The present invention also encompasses methods for abbreviating antenna size for an antenna in the VHF and UHF regions with a multiple band electrically small planar microstrip antenna, comprising the steps of positioning a narrow radiating strip and a group of radiating members on a microstrip dielectric substrate, the group of radiating members being formed with a set of unequal, or unlike, dimensions and a greater width than the narrow radiating strip, stacking the microstrip dielectric substrate on a ground plane; connecting the narrow radiating strip and radiating members at a junction, the antenna having an original length and an effective impedance at the junction; configuring each unlike radiating member with a rear edge opposing the junction; separating the unlike radiating members with at least one gap therebetween that begins in the vicinity of the connector pin and extends through the junction; projecting a connector pin downward through the narrow radiating strip and dielectric substrate to the ground plane; and shorting the narrow radiating strip. Other method steps are folding the narrow radiating member downward to partially cover the dielectric substrate and ground plane to form a front edge opposing the rear edges, the narrow radiating strip terminating at the connector pin; decreasing the effective impedance by connecting the narrow radiating strip and unlike radiating members at the junction, which results in a reduced impedance allowing the original length to be abbreviated; and providing a distinct resonant frequency in the VHF and UHF regions based upon the unlike radiating members being unequally dimensioned.

These embodiments of the present invention are intended to be illustrative and not limiting with respect to the variety of possible embodiments. It is to be further understood that other features and modifications to the foregoing detailed description of the estimating methods and devices are all considered to be within the contemplation of the present invention, which is not limited by this detailed description.

Those skilled in the art will readily appreciate that any number of configurations of the present invention and numerous modifications and combinations of materials, components, geometrical arrangements and dimensions can achieve the results described herein, without departing from the spirit and scope of this invention. Accordingly, the present invention should not be limited by the foregoing description, but only by the appended claims.

What I claim is:

1. A multiple band electrically small compact planar microstrip antenna, comprising:

a narrow radiating strip and a plurality of unlike radiating members are positioned on a microstrip dielectric substrate;

each of said plurality of unlike members having a set of unequal dimensions and a greater width than said narrow radiating strip;

said microstrip dielectric substrate being stacked on a ground plane;

said narrow radiating strip and said plurality of unlike radiating members being connected at a junction;

said antenna having an original length and an effective impedance at said junction;

each of said plurality of unlike radiating members being configured with a rear edge opposing said junction and being separated by at least one gap therebetween;

a connector pin, projecting downward through said narrow radiating strip and said dielectric substrate to said ground plane, shorts said narrow radiating strip;

said narrow radiating strip, being folded downward to partially cover said dielectric substrate and said ground plane forms a front edge opposing said rear edges, terminates at said connector pin; and said effective impedance being decreased by said narrow radiating strip and said plurality of unlike radiating members being connected at said junction, results in a reduced impedance allowing said original length to be decreased to an abbreviated length, and each of said plurality of unlike radiating members, having said set of unequal dimensions, provides a distinct resonant frequency in the VHF and UHF regions.

2. The multiple band electrically small compact planar microstrip antenna, as recited in claim 1, further comprising said at least one gap begins in the vicinity of said connector pin and extends through said junction.

3. The multiple band electrically small compact planar microstrip antenna, as recited in claim 2, further comprising said plurality of unlike radiating members being rectangularly shaped.

4. The multiple band electrically small compact planar microstrip antenna, as recited in claim 3, wherein said plurality of unlike radiating members are two unlike radiating members.

5. The multiple band electrically small compact planar microstrip antenna, as recited in claim 4, further comprising said at least one gap being a longitudinal gap that terminates at said rear edges.

6. The multiple band electrically small compact planar microstrip antenna, as recited in claim 3, wherein said plurality of unlike radiating members are three unlike radiating members.

7. The multiple band electrically small compact planar microstrip antenna, as recited in claim 6, further comprising said at least one gap being two "L" shaped gaps separating said three unlike radiating members.

8. The multiple band electrically small compact planar microstrip antenna, as recited in claim 3, wherein said plurality of unlike radiating members are four unlike radiating members.

9. The multiple band electrically small compact planar microstrip antenna, as recited in claim 8, further comprising:

said at least one gap being a longitudinal gap and two "L" shaped gaps separating said four unlike radiating members; and said longitudinal gap terminates at said rear edges.

10. The multiple band electrically small compact planar microstrip antenna, as recited in claim 2, further comprising said plurality of unlike radiating members being non-rectangularly shaped.

11. A dual band electrically small compact planar microstrip antenna, comprising:

a narrow radiating strip and a pair of unlike radiating members are positioned on a microstrip dielectric substrate;

each of said pair of unlike radiating members having a set of unequal dimensions and a greater width than said narrow radiating strip;

said microstrip dielectric substrate being stacked on a ground plane;

said narrow radiating strip and said pair of unlike radiating members being connected at a junction;

said antenna having an original length and an effective impedance at said junction;

each of said pair of unlike radiating members being configured with a rear edge opposing said junction and being separated by a longitudinal gap therebetween;

a connector pin, projecting downward through said narrow radiating strip and said dielectric substrate to said ground plane, shorts said narrow radiating strip;

said narrow radiating strip, being folded downward to partially cover said dielectric substrate and said ground plane forms a front edge opposing said rear edges, terminates at said connector pin; and said effective impedance being decreased by said narrow radiating strip and said pair of unlike radiating members being connected at said junction, results in a reduced impedance allowing said original length to be decreased to an abbreviated length, and each of said pair of unlike radiating members, having said set of unequal dimensions, provides a distinct resonant frequency in the VHF and UHF regions.

12. The dual band electrically small compact planar microstrip antenna, as recited in claim 11, further comprising said longitudinal gap begins in the vicinity of said connector pin, extends through said junction and terminates at said rear edges.

13. The dual band electrically small compact planar microstrip antenna, as recited in claim 12, further comprising said pair of unlike radiating members being rectangularly shaped.

14. The dual band electrically small compact planar microstrip antenna, as recited in claim 12, further comprising said pair of unlike radiating members being non-rectangularly shaped.

15. A method for abbreviating antenna size for an antenna in the VHF and UHF regions with a multiple band electrically small planar microstrip antenna, comprising the steps of:

positioning a narrow radiating strip and a plurality of unlike radiating members on a microstrip dielectric substrate, said plurality of unlike radiating members being formed with a set of unequal dimensions and a greater width than said narrow radiating strip;

stacking said microstrip dielectric substrate on a ground plane;

connecting said narrow radiating strip and said plurality of unlike radiating members at a junction, said antenna having an original length and an effective impedance at said junction;

configuring each of said plurality of unlike radiating members with a rear edge opposing said junction;

separating said plurality of unlike radiating members with at least one gap therebetween, said at least one gap beginning in the vicinity of said connector pin and extending through said junction;

projecting a connector pin downward through said narrow radiating strip and said dielectric substrate to said ground plane;

shorting said narrow radiating strip;

folding said narrow radiating strip downward to partially cover said dielectric substrate and said ground plane to form a front edge opposing said rear edges, said narrow radiating strip terminating at said connector pin;

decreasing said effective impedance, by connecting said narrow radiating strip and said plurality of unlike radiating members at said junction, results in a reduced impedance allowing said original length to be abbreviated; and providing a distinct resonant frequency in said VHF and UHF regions based upon each of said plurality of unlike radiating members having said set of unequal dimensions.

16. The method for abbreviating antenna size for the antenna in the VHF and UHF regions with the multiple band electrically small planar microstrip antenna, as recited in claim 15, further comprising the step of forming said plurality of unlike radiating members in a rectangular shape.

17. The method for abbreviating antenna size for the antenna in the VHF and UHF regions with the multiple band electrically small planar microstrip antenna, as recited in claim 16, wherein:

said plurality of unlike radiating members are two unlike radiating members; and said at least one gap is a longitudinal gap that terminates at said rear edges.

18. The method for abbreviating antenna size for the antenna in the VHF and UHF regions with the multiple band electrically small planar microstrip antenna, as recited in claim 16, wherein:

said plurality of unlike radiating members are three unlike radiating members; and said at least one gap is two "L" shaped gaps separating said three unlike radiating members.

19. The method for abbreviating antenna size for the antenna in the VHF and UHF regions with the multiple band electrically small planar microstrip antenna, as recited in claim 16, wherein:

said plurality of unlike radiating members are four unlike radiating members;

said at least one gap is a longitudinal gap and two "L" shaped gaps separating said four unlike radiating members; and said longitudinal gap terminates at said rear edges.

20. The method for abbreviating antenna size for the antenna in the VHF and UHF regions with the multiple band electrically small planar microstrip antenna, as recited in claim 15, further comprising the step of forming said plurality of unlike radiating members to be non-rectangularly shaped.

* * * * *